US006508981B1

(12) United States Patent
Perrin et al.

(10) Patent No.: US 6,508,981 B1
(45) Date of Patent: Jan. 21, 2003

(54) HIGH TEMPERATURE OXIDATION RESISTANT DUCTILE IRON

(75) Inventors: A. Renaud Perrin, Cambridge (CA); Gene B. Burger, Cambridge (CA); Gangjun Liao, Brantford (CA)

(73) Assignee: Wescast Industries, Inc., Sterling Heights, MI (US)

( * ) Notice: Subject to any disclaimer, the term of this patent is extended or adjusted under 35 U.S.C. 154(b) by 0 days.

(21) Appl. No.: 09/865,060

(22) Filed: May 24, 2001

(51) Int. Cl.[7] ..... C22C 37/04; C22C 37/10

(52) U.S. Cl. ..... 420/28; 420/30; 420/33; 148/321

(58) Field of Search ..... 420/30, 28, 33, 420/24, 25; 148/321

(56) References Cited

PUBLICATIONS

English abstract of Russian patent 441331A, Apr. 23, 1975.*
English abstract of Russian patent 2012662, May 15,1994.*

* cited by examiner

*Primary Examiner*—Deborah Yee
(74) *Attorney, Agent, or Firm*—Harness, Dickey & Pierce, P.L.C.

(57) ABSTRACT

A nodular or compacted graphite iron contains up to 6% aluminum, with high strength and good ductility over a wide temperature range, combined with excellent hot oxidation resistance and improved thermal fatigue resistance compared to ductile and SiMo ductile irons. The iron alloy of the invention contains, in addition to iron, from about 1 to about 6% aluminum, from about 2 to about 4.5% silicon, carbon in an amount where the weight percent carbon plus ⅓ the weight percent of silicon is up to about 5.2%, greater than or equal to about 0.02% cerium and up to about 1.5% molybdenum. All percentages are based on the total weight of the composition. The compositions may further contain up to about 7% nickel by weight.

26 Claims, 9 Drawing Sheets

*Graphite Structure in 3.4%C -4.0%Si-3.0% A1. Note good nod count and nodularity*

215
220
1
210
225
11
230
220
235
246
11
244
240
242
248
245
252
250
Ar
1

Graphite Structure in 3.4%C -4.0%Si-3.0% A1. Note good nod count and nodularity

*Structure in 3.4%C -4.0%Si-3.0% A1. after etching, indicating low carbide and pearlite content*

HIGH TEMPERATURE OXIDATION RESISTANT DUCTILE IRON

FIELD OF THE INVENTION

The present invention relates to cast iron with improved ductility and high temperature properties. More specifically, the present invention relates to cast iron alloys which contain relatively high levels of aluminum, yet are not brittle.

BACKGROUND OF THE INVENTION

Cast iron alloys, and parts cast from the alloys are subject in use to an ever increasing range of challenging environments. Such parts must operate at high temperatures and withstand temperature cycling between periods of use. The parts must have good oxidation resistance and be resistant to mechanical and thermal fatigue and oxidative cracking.

Turbocharger turbine housings and exhaust manifolds are examples of components which are subjected to challenging environments. Typically the in use temperatures for such components are on the order of 900° C. or greater. For example, with today's high performance engines it is not uncommon to see in use temperatures reach 1000° C. and higher.

In addition to exhibiting high temperature capabilities, iron alloys generally must be easy to handle, machine, and abrasively clean at room temperature. Further, alloys are desired which are less brittle at room temperature and at the temperature of use.

Cast iron alloys which are currently known generally have a relatively high mechanical strength but tend to have a relatively low ductility, i.e., the components manufactured therefrom tend to be somewhat brittle. It is desirable to increase the mechanical strength of the alloy at elevated temperatures, while maintaining or improving the ductility at both room and elevated temperatures.

In an attempt to address the above described concerns of high strength at elevated temperature good thermal fatigue resistance, good oxidation resistance, and reasonable ductility, industry has developed ductile cast irons with high silicon and high molybdenum, commonly known as SiMo alloys. The SiMo alloys exhibit improved high temperature strength and thermal fatigue resistance over other ductile cast irons, as well as improved high temperature oxidation resistance. However, these property improvements are accompanied with a somewhat lower ductility at ambient temperatures and reduced machinability than other ductile cast irons. Despite these improvements in high temperature strength and thermal fatigue resistance and oxidation resistance, further enhancement of these properties would be desirable, in an alloy with acceptable ductility. The high oxidation rate at the high temperatures is especially a problem in parts such as exhaust manifolds and turbocharger turbine housings, where as indicated above the in-use temperatures can reach 1000° C. and higher. In addition, cast irons in these applications are also subject to thermal fatigue cracking. This is due at least in part to the fact that the ferrite-austenite phase change temperature of these alloys is typically below the temperature of use. Therefore, in use the part is cycled up to temperatures associated with engine operation and then back down to room temperature. The part undergoes the ferrite austenite phase change upon heating and again upon cooling. This continued thermal cycling and associated phase transformation is said to contribute to thermal fatigue in the part which, in time, leads to cracking.

In addition to SiMo alloys, iron alloys that contain aluminum are also known. Such high aluminum iron alloys tend to have better high temperature oxidation resistance than conventional iron alloys. Furthermore, the aluminum content of the iron shifts the ferrite-austenite phase change temperature to higher temperatures, with the shift being greater as more aluminum is added. This is desirable for applications such as exhaust manifolds because it may be possible to formulate an alloy with a phase change temperature above the use temperature. Components formed from such alloys would not be subject to fatigue cracking associated with phase changes developed through thermal cycling. As higher aluminum contents push the phase change temperature to higher levels, higher use temperatures may be reached. Interestingly, it has been observed that as one goes to higher aluminum content in an iron alloy, the alloys become harder and more brittle at room temperature. Parts cast from the brittle iron alloys are more difficult to machine or to abrasively clean because of their hardness, and they are subject to fracture during subsequent processing and handling because of their brittleness.

According to U.S. Pat. No. 5,236,660 to Reynaud, cast iron alloys containing silicon and aluminum have acceptable high temperature properties and as such can replace the more expensive high nickel alloys in high temperature applicants. However, the Reynaud patent discloses data indicating that alloys containing high levels of those elements are too brittle for use in such applications. Specifically, Reynaud defines an empirical parameter, the "silicon equivalent", as equal to the silicon level (in wt %) plus 80% of the aluminum level (in wt %) and states that when the silicon equivalent of the alloy is greater than 7.1% articles cast from the alloy are too brittle for high temperature use. Further, within the limits of the silicon equivalent as defined, the silicon level can range from 3.9 to 5.3%, but the aluminum level can be no greater than 2.5%.

Therefore, it would be desirable to provide an iron alloy with a high level of aluminum and combining properties of high mechanical strength and high ductility. It would also be desirable to provide parts cast from such an alloy that could be readily machined and abrasively cleaned at low temperature, and could also withstand oxidation at high in-use temperatures. Because the ferrite-austenite phase transformation temperature would be above the in-use temperature in many engine applications, such parts used under these conditions would be more resistant to fatigue cracking associated with any transformation-induced thermal cycling.

SUMMARY OF THE INVENTION

Figure 1:
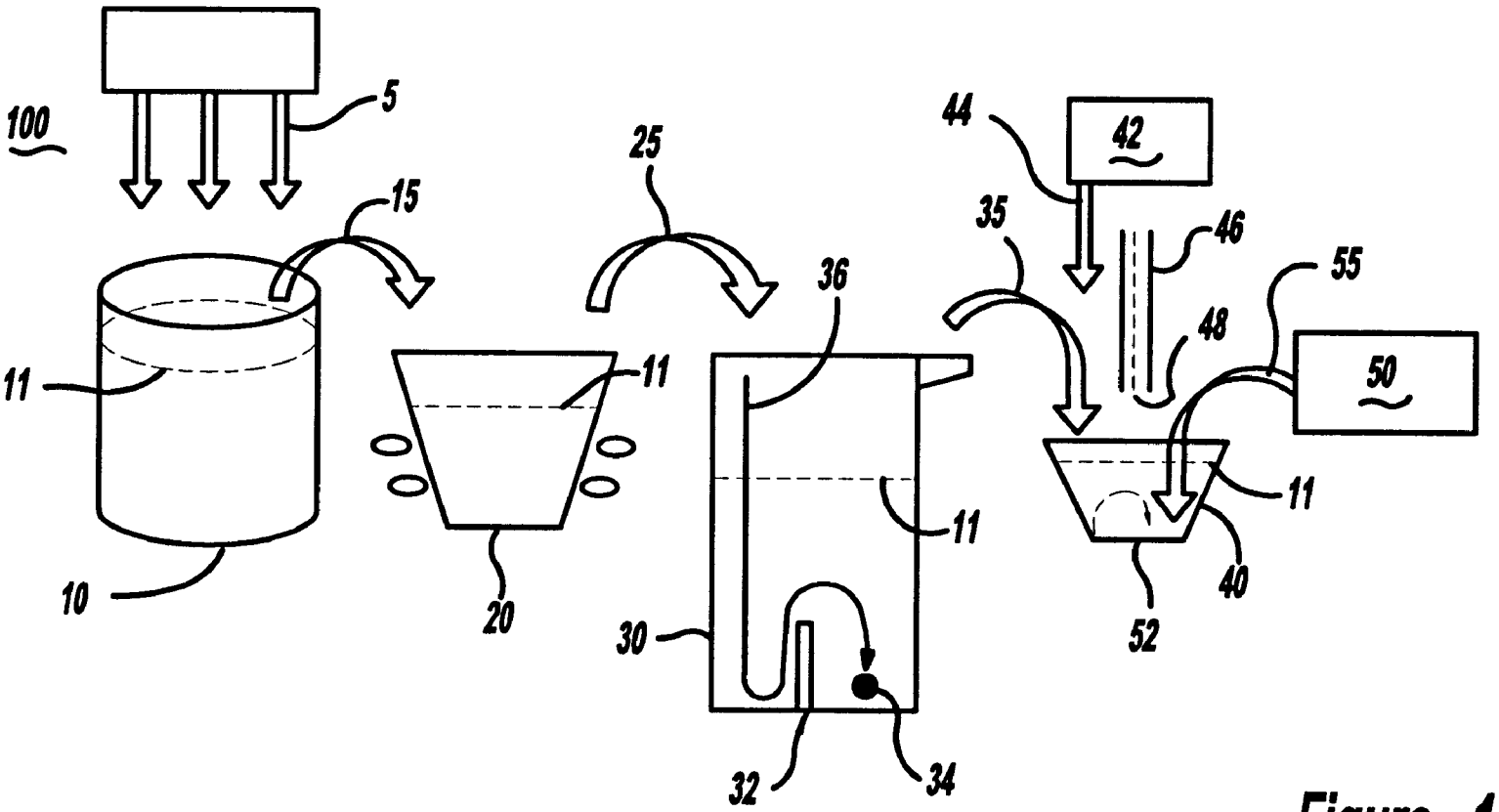
FIG. 1 is a process flow diagram illustrating one embodiment of a process of the invention.

The invention provides a nodular or compacted graphite iron containing up to 6% aluminum, with high strength and good ductility over a wide temperature range, combined with excellent hot oxidation resistance and improved thermal fatigue resistance compared to ductile and SiMo ductile irons. The iron contains alloying elements that enhance the high temperature thermal fatigue and hot oxidation resistance in service. In preferred embodiments, the iron alloy of the invention contains, in addition to iron, from about 1 to about 6% aluminum, from about 2 to about 4.5% silicon, carbon in an amount where the weight percent carbon plus ⅓ the weight percent of silicon is up to about 5.2%, greater than or equal to about 0.02% cerium and up to about 1.5% molybdenum. All percentages are based on the total weight of the composition. The compositions may further contain up to about 7% nickel by weight.

Articles cast from the compositions of the invention are ductile and can withstand multiple thermal cycling without failure. Such articles find use in a variety of automotive transportation and industrial applications. Such applications include, but are not limited to, exhaust components such as exhaust manifolds, engine components including blocks, transmission components, fuel cell components, burner components, and mold components. Generally the cast iron compositions of the invention may be used in any application calling for chrome molybdenum steel, ductile iron, or a low grade stainless steel.

DETAILED DESCRIPTION OF THE INVENTION

The compositions and methods of the invention provide cast iron articles having desired combinations of ductility, high oxidation resistance, and thermal fatigue resistance. They are useful generally in any iron application, particularly high temperature ductile or high nickel iron applications. Examples include, but are not limited to, automotive exhaust components including exhaust manifolds and catalytic converter cans, turbocharger components including turbine housings and center housings, and engine components such as blocks, heads, cylinder liners, cam shafts, crank shafts, dampers, bed plates, valve train components, pistons, piston inserts, bearing caps, and pump housings. The cast articles of the invention also find use as transmission components including cases, carriers, housings, barring caps, fly wheels, and pump housings. Furthermore, they can be used as fuel cell components including cases and liners.

In the industrial area of application, articles made of the compositions of the invention are useful as industrial components such as burners, linings, molds, machinery fixtures and bases, pipes and valves, among others. They also find use in a wide variety of agricultural equipment. In general, the materials and articles of the invention find uses wherever chrome molybdenum steel, ductile iron, or low grade stainless steel can be used.

Cast iron articles of the invention are prepared by pouring a molten composition into a mold. The molten composition is a cast iron composition containing, in addition to greater than about 50% by weight iron, aluminum at levels from about 1% by weight to about 6% by weight and cerium at a level greater than or equal to about 0.02% by weight. Preferably, the cerium content of the cast iron composition is greater than or equal to about 0.03%. In a preferred embodiment, the aluminum content of the cast iron composition is greater than about 2.5%. In another preferred embodiment, the aluminum content is from about 3% to about 4% by weight.

The iron compositions typically further comprise silicon and carbon. Silicon is generally present in an amount of from about 1% to about 5% by weight. Lower silicon levels tend to lead to formation of undesirable flaky graphite in the molded articles of the invention. Preferably, silicon is present at about 1.5% or greater and, more preferably, about 2% or greater. In a preferred embodiment, silicon is present at a level of less than about 4.5%. Carbon is present in an amount such that the weight percent carbon plus ⅓ the weight percent silicon is numerically equal to a value up to about 5.5%, preferably up to about 5.4% and, more preferably, up to about 5.2%.

The cast iron compositions also typically contain up to about 1.5% by weight molybdenum. Molybdenum generally increases the tensile strength, hardness and hardenability of cast irons. It improves high temperature creep and fatigue resistance, and increases carbide formation as found in the final structure on grain boundaries, often in pearlitic regions. Molybdenum levels on the higher side of the range may be used to increase the high temperature strength of the cast articles. As noted above, higher molybdenum content is generally associated with a higher carbide content. Because of the higher carbide content, the cast articles will tend to be more brittle with some risk of cracking during thermal cycling, as for example, in normal automotive engine use, or under simulative or accelerated engine dynamometer durability tests. It is believed that at a molybdenum level of above about 1.5%, the carbide content of the resulting composition would be greater than desirable for producing a ductile material.

It is generally preferred that the compositions of the invention contain less than 0.02% sulfur. Higher sulfur levels tend to lead to a requirement for additional magnesium additions and cause more rapid chemical fade during the pretreatment step to control production of either compacted (vermicular) or nodular graphite structures. For similar reasons, it is preferred to keep the oxygen content of the compositions low, typically less than about 0.005% (50 ppm). Phosphorus should also be kept to minimum, preferably below about 0.04%.

Because of the molybdenum and silicon content of the composition, as well as its desirable high temperature properties, the composition of the invention can be referred to as a high temperature SiMo iron. The terms "compositions of the invention" and "high temperature SiMo" will be used interchangeably to refer to the cast iron compositions and molded articles of the invention.

The desirable properties of ductility and machinability exhibited by the compositions of the invention are believed to derive from the microstructure of the high temperature SiMo. The graphite present in the molded articles in predominantly present in either nodular or vermicular form. When greater than 50% of the carbon is present as graphite nodules, the compositions are generally referred to as ductile irons. When the nodularity is less than about 50% (i.e., when less than about 50% of the carbon is present as graphite nodules), the compositions are referred to as compacted graphite iron if the remainder of the carbon is present as vermicular graphite. Generally, high levels of flake graphite are less desirable. In compacted graphite irons of the invention, nodularity is generally about 15% or greater, with the remainder of the graphite predominantly present in vermicular form. In ductile irons of the invention, the nodularity is greater than 50%, preferably greater than 70%, and the balance of the carbon is predominantly in vermicular form. In a preferred embodiment, the nodularity is greater than about 90%.

In the high temperature SiMo, some degenerate graphite, that is, graphite not in nodular or vermicular form, may be present. Such is permissible as long as the flake or chunky graphite is small enough, so that it does not create a crack nucleation site or a crack propagation path. The high temperature SiMo has a molybdenum rich eutectoid, which can be viewed as a "high moly pearlite." The pearlite may be present in the cast articles of the invention at a level up to 25%.

In general, carbides in the compositions of the invention are to be avoided. At room temperature, they will cause the iron to be brittle. Iron carbide is a hard and brittle phase called "cementite" or "massive carbide". The presence of too much carbide will make a part difficult to handle. The part will be more susceptible to crack propagation under stress or load, and it may crack during tumble cleaning, or in service due to mechanical stresses. Heat treatment will tend to decompose the iron carbide and the amount of pearlite (which is a lamellar mix of ferrite and cementite). Molybdenum carbides are present in SiMo ions, and are often on grain boundaries and associated with pearlite. At levels of only a few percent, the molybdenum carbide is not detrimental to the mechanical properties. Fine pearlite up to about 25% is permitted in most SiMo ductile ions.

It is important to keep the carbide content as low as possible. A maximum of about 5% is generally considered a good target. The carbide in the pearlite is not counted in the 5%. The 5% refers generally to isolated iron carbide and to molybdenum carbide. After high temperature dyno testing cycles, or after heat treatment as noted above, the pearlite and iron carbide content of the cast articles will generally decrease.

The cast iron articles of the invention are in general readily machinable. A material with good machinability requires easy formation of machining chips, easy break away of the chips, a reasonable tool wear rate, and reasonable fixturing. The parts may be machined dry or with a machining coolant or lubricant. Good machinability is thought to be in general due to the good ductility of the materials. It is known that prior alloys of iron containing up to 6% aluminum and more were brittle and therefore difficult to machine. Machinability is also related to carbide content. Because pure iron carbide is non-ductile, high levels of carbide in a composition tend to make the composition brittle and difficult to machine. By reducing the carbide content, and producing a good nodular structure, the current invention provides for cast iron compositions containing up to 6% aluminum that are ductile and machinable.

Ductility can also be expressed as a percent elongation. Typically, a tensile test is run on cast articles and a percent elongation until break is measured. At 700° C., the percent elongation for the high temperature SiMo of the invention is generally about 16%, which compares favorably to a value of 22–28% for regular SiMo iron. At 900° C., the percent elongation for the high temperature SiMo increases to about 33–40%. For many applications such as exhaust manifolds, the property of ductility is as important or more important than strength. A material with high ductility can expand and contract over the temperature cycles encountered during operation of an internal combustion engine. In an exhaust manifold, the requirement for strength is not as great—the part generally needs enough strength to withstand the pressure of the gases. Another manifestation of high ductile cast iron articles is resistance to breaking when dropped onto a hard surface. Ductile materials tend to survive a fall onto a hard surface, whereas less ductile materials tend to shatter on impact. ASTM Standard E 8 specifies uniaxial static loading of a standard specimen in order to develop engineering tensile stress-strain curves, including uniform elongation and elongation at failure.

Ductile materials such as those of the invention are materials which produce a measurable elongation at room temperature in tensile tests such as ASTM E-8. Generally, the materials exhibit ductility such that a tensile test results in an elongation greater than zero. Typically, the materials exhibit an elongation of about 1% or greater. Generally, an elongation result of less than about 1% is considered fairly brittle. Such low elongations may be difficult to determine with tensile tests such as ASTM E-8. Because precise measurement of elongation below about 0.7–1.0% is less reliable, it is more descriptive to describe the results of a tensile test in that range as an elongation greater than zero.

Molded articles of the invention are prepared by pouring a molten composition into a mold. The molten composition is prepared by a process containing a number of steps generally familiar to those of skill in the art of making cast iron articles. In a first step, a number of material streams are provided that contain sources of the elements iron, silicon, carbon, and molybdenum. Optionally, aluminum bearing materials and/or cerium bearing materials can also be provided. The material streams are melted together to form a first melt. The first melt generally contains at least the elements iron, silicon, carbon, and molybdenum. Optionally, the first melt contains from 0–6% aluminum, and from 0–0.8% cerium, the percentages being by weight based on the total weight of the molded article to be produced. The first melt is treated with a nodularizer containing magnesium or other sulfide/oxysulfide/silicate former to form a second melt containing graphite nucleation sites. Optionally, aluminum bearing materials and/or cerium bearing materials may be added at this point to provide 0–6% aluminum, and 0–0.8% cerium, as above. Next, the second melt is inoculated with an inoculant to provide nucleation sites in addition to those generated by treatment with the nodualizer. Before pour, cerium metal can be optionally added to bring the final cerium content of the molten composition into the range of from about 0.02% to about 0.8% by weight. Preferaably, the cerium content will be in the range of from about 0.02% to about 0.2%. Also at this point, aluminum bearing materials may be added to the molten composition to bring the final aluminum content of the molten composition into the range of from about 1% to about 6% by weight.

In one embodiment, the aluminum additions to the molten composition may be made predominantly after the treating and inoculation steps described above. In a preferred embodiment, the first melt contains up to 1% by weight aluminum. In another preferred embodiment, the first melt comprises less than 0.1% aluminum. The latter represents a process wherein aluminum bearing materials are not purposefully added to the first melt.

In other embodiments of the process, there is no intentional use of cerium containing metals to form the first melt so that the first melt contains only trace amounts of cerium.

Subject to the discussion below, he cast iron molded articles generally contain from about 1 to about 6% by weight aluminum, from about 2 to about 4.5% by weight silicon, carbon in such an amount that the weight percent carbon plus ⅓ the weight of silicon is up to 5.2%, molybdenum at a level of about 1.5 weight percent or less, and greater than about 0.02% cerium. In a preferred embodiment, cerium is added during the process in such amounts that the molded articles comprise about 0.03% by weight or greater.

The cast iron articles generally contain from about 1% to about 6% by weight aluminum. Preferably, the articles contain greater than 2.5% by weight aluminum. In a preferred embodiment, the articles contain about 3 to about 4% by weight aluminum.

As noted above, cerium-bearing materials may be added at several points during the process. It is preferred to add cerium as cerium metal. In a preferred embodiment, the cerium metal is added as part of a mischmetal containing cerium and other rare earth elements such as praseodymium, neodymium, and lanthanum.

Likewise, aluminum-bearing materials may be added at several points during the process. It is preferred to make such aluminum additions by introducing an aluminum composition below the surface of the melt to which it is applied. For example, an aluminum composition may be introduced below the surface of the first melt. In a preferred embodiment, a solid aluminum composition is plunged below the surface of the first melt or of the second melt.

A variety of material streams may be used to provide the elements of iron, silicon, carbon, and molybdenum for the first melt. Pig iron may be used as a source of iron. Other iron sources may also be conveniently used, including steel scrap and other ductile or nodular or compacted graphite iron scrap and returns. Carbon is generally added as graphite but could also be added as silicon carbide. Other additions to the first melt can be ferrosilicon alloys and ferromolybdenum alloys. Ferrosilicon alloys, for example, may typically contain 65 to 75% silicon by weight, balance iron with small amounts of other elements. Ferromolybdenum may typically contain about 60% molybdenum, balance iron and small amounts of other elements. Generally, a variety of such streams are first charged into a melting furnace. After the streams are melted together, it is preferred to check the elemental content. If it is outside specifications, other materials can be added to bring them within specifications. In this way, the process provides a convenient way of reusing scrap and recycling returns from the pouring process.

The nodularizers added to the first melt have several functions. First, they are believed to provide a fine dispersion of MgS, CaS, or MgO.SiO2 particles by reacting with the iron melt. The particles act as substrates on which calcium, strontium, or barium silicates or aluminosilicates can readily form upon subsequent additions of an inoculant bearing for example, calcium, barium, strontium, zirconium, and/or aluminum. The nodularizer, or pre-treatment alloy, reacts with the melt to pre-seed the molten metal so that many potential graphite nucleation sites can form. In some base irons, dependant upon conditions such as the oxygen, sulfur, and residual rare earth or calcium content, pre-treatment alone may result in significant inoculation potential. That is, a significant number of particles effective in acting as nucleation sites for graphite may be produced.

Another function of the nodularizer or pre-treatment alloy is to maintain favorably low levels of sulfur and oxygen in the melt so as to provide conditions for the growth of graphite resulting in spherodial or nodular graphite. The low oxygen and sulfur levels are maintained through the formation for example of stable oxides and sulfides of magnesium or calcium.

Nodularizers often contain cerium, which scavenges the melt to form intermetallic compounds with "subversive" elements such as lead, antimony, arsenic, or titanium. If such subversive elements are present in the melt and not tied up in compound form, they tend to prevent the formation of nodular graphite.

In a preferred embodiment, the nodularizer contains magnesium. Residual magnesium in the melt results in undercooling, that is, it depresses the eutectic austenite graphite temperature. This results in a larger fraction of the complex particles formed after inoculation being effective nucleation sites for graphite. This will generally result in a finer dispersion of graphite nodules in the cast article. The pre-treatment alloy may also contain alloying additions such as copper which will modify the structure of the matrix. The matrix is the non-graphitic portion of the iron alloy.

Nodularizers or pretreatment alloys are commercially available. Inoculant treatment can vary over a wide range, but it is generally preferred to use an inoculant in an amount of about 0.05 to about 1.2 weight percent, based on the total weight of the cast article. In a preferred embodiment, the nodularizer used is ReMag® magnesium ferrosilicon, commercially available from Elkem Metals Company. In addition to magnesium and silicon, the nodularizer contains from about 1.75 to about 2.5% rare earth. As noted above, base irons often contain small amounts of contaminants that hinder formation of graphite nodules. It is believed that the rare earth elements in nodularizers such as ReMag neutralize the contaminants so that a desirable spherodial graphite structure can be formed. The PEM nodualizers, available commercially from Pechiney, are ferrosilicon magnesium alloys characterized by a magnesium content, a calcium content, and a rare earth content. For example, PEM nodularizer 522 typically contains about 5% magnesium, about 2% calcium, and about 2% rare earth. PEM nodularizer 931 typically contains about 9% magnesium, about 3% calcium, and about 1% rare earth. The above examples of commercially available nodularizers are meant to be exemplary only, and not intended to limit the scope of the invention in any way. Other commercially available nodularizers are listed in Table I below, by way of non-limiting example.

TABLE I

| Trade Name & Supplier | Approximate Treatment Level Range | Preferred Range | Remarks |
|---|---|---|---|
| ReMag-Elkem | 0.5–2.0% | 0.75–1.0% | Low-magnesium-ferrosilicon alloy |
| MgFeSi-Elkem | 0.3–2.0% | 0.5–1.0% | High-magnesium-ferrosilicon alloy |
| PEM522-Pechiney | 0.5–2.0% | .75–1.0% | Magnesium-calcium-ferrosilicon alloy |
| PEM931-Pechiney | 0.3–2.0% | 0.5–1.0% | High-magnesium-calcium ferrosilicon alloy |

The inoculating step and the inoculants used in the process also have several functions. First, they provide for the formation, through reaction with the melt, of calcium, strontium, or barium silicates or aluminosilicates which preferentially precipitate on the precursor or pre-seed "substrate" particles formed during nodularizer pre-treatment additions. The inoculants used can generally be ferrosilicon alloys containing, for example, calcium, barium, strontium, zirconium, and/or aluminum. Available inoculants often include rare earth elements, for example cerium as either pure cerium or as part of a cerium misch metal. The silicate or aluminosilicate layer formed on the pre-seed particles has a structure on which graphite can easily nucleate. The inoculant thus provides energetically favorable nucleation sites for graphite, making a large fraction of the particles produced through pretreatment additions effective in nucleating graphite. To form and maintain a large number of nucleation sites, the inoculant additions are preferably made shortly before pouring. If the inoculant addition is made too early in the process, flotation and coalescence effects may tend to remove and reduce the number of nucleant particles in the melt, thus reducing the potential number of sites at which graphite can form.

Inoculants for cast iron are commercially available. In a preferred embodiment, the inoculant used is Ultraseed®) available from Elkem. It contains about 70–76% by weight silicon, about 0.75 to about 1.25% by weight calcium, from about 1.5 to about 2% by weight cerium, and from about 0.75 to about 1.25% by weight aluminum. It is believed that inoculants such as Ultraseed provide formation of extra nucleations sites in ductile iron in addition to those generated from the nodularizer or pre-treatment alloy treatment. Other commercial sources of inoculants are listed in Table If below, by way of non-limiting example.

TABLE II

| Trade Name & Supplier | Approximate Treatment Level Range | Preferred Range | Remarks |
|---|---|---|---|
| Ultraseed ® - Elkem | 0.05–1.0% | 0.6–1.0% | Cerium-Al—Ca-ferrosilicon alloy (contains S as iron pyrite and oxygen as wustite or iron oxide) |
| Calsifer - Elkem | 0.1–1.2% | 0.6–1.2% | Al—Ca bearing ferrosilicon alloy |
| Spherix ® - Perchiney | 0.05–0.4% | 0.1–0.4% | Bismuth-Al—Ca-containing ferrosilicon alloy |
| Inolate ® 40 - Pechiney | 0.05–0.4% | 0.1–0.4% | Bismuth-Al—Ca-containing ferrosilicon alloy |
| Amerinoc ® - Pechiney | 0.05–0.4% | 0.1–0.4% | Bismuth-Al—Ca-containing ferrosilicon alloy |

Rare earths contained in the inoculant promote an appropriate level of eutectic under cooling so that the energetics favor a large fraction of the potential nucleant particles effective in nucleating graphite. The result is a fine closely spaced dispersion of graphite nodules, with fewer primary carbides, lower pearlite in the matrix, and lower microshrink. Appropriate levels of cerium also stabilize the austenite/melt interface around the graphite/austenite eutectic during solidification, so that the nodular growth of graphite is stabilized by a spherical austenite shell, with resulting symmetric carbon diffusion distances through the austenite shell to the graphite nodule.

Another type of inoculant that may be used works through the formation of a distribution of particles of intermetallic compounds between bismuth and various rare earth elements. The structure of some of these compounds also provides effective nucleation sites for graphite. Commercially available inoculants such as Spherix®, Inolate®, and Amerinoc® contain bismuth in addition to rare earths.

The pre-treatment or nodularizer additions form a dispersion of pre-seed particles which may act or provide for some degree of graphite nucleation. The pre-seed particles act as a substrate on which the reactant product formed by the reaction of the inoculant with the melt and/or pre-seed particle can easily precipitate. The reactant product formed on the surface of the pre-seed particle offers a much more effective (i.e., energetically favorable) site on which graphite can nucleate. In general, inoculation should be carried out after pre-treatment, to most efficiently promote the formation of large numbers of potent graphite nucleation sites. It may be possible to add the nodularizer and inoculant simultaneously, but this is less preferred. Such simultaneous addition would not make the most effective use of the additions in promoting graphite nucleation. For the same reasons, inoculant additions made prior to pre-treatment is less preferred. In a preferred embodiment, the inoculation step is carried out just prior to pouring.

If the cerium content in either or both the pre-treatment alloy or inoculant is high enough, the cerium content in the cast iron compositions of the invention may be achieved through additions of the nodularizer or inoculant. Usually, it will be necessary to add additional amounts of cerium. These cerium additions should be in the form of cerium metal, and not as sulfides, oxides, or other chemical compounds. To achieve beneficial effects, the cerium should be present as a metal dissolved in the molten iron alloy, and be able to form oxides, sulfides, oxysulfides, or other compounds in situ in the melt, so that a fine dispersion to provide effective graphite sites may result.

Cerium additions can be made either as a pure cerium addition or through cerium mischmetal. A pure cerium addition can be in the form of a high cerium rare earth containing approximately 92% cerium, 5% lanthanum, 2% neodymium, 1% praseodymium, as well as other rare earths and yttrium. A typical mischmetal contains approximately 50% cerium, 33% lanthanum, 12% neodymium, 4% praseodymium, plus other rare earths and yttrium. All percentages are by weight of the total cerium containing composition. In a preferred embodiment, the cerium addition is carried out concurrently with the addition of the inoculant. As noted above, some inoculants that are commercially available contain relatively high cerium levels. Generally, however, to achieve the cerium levels of the invention, it is usually required to add cerium in the form of cerium metal as well as any cerium containing pretreatment alloys or inoculants.

The process of the invention provides for aluminum-bearing materials to be added possibly at several points during the process. In a preferred embodiment, the aluminum additions are made after the inoculant treatment. Whenever the aluminum addition is made, the aluminum bearing materials may be made of pure aluminum or a number of other materials containing minor impurities. The aluminum-bearing materials may be scrap, returns, alloys, pure aluminum, wire, and may be in a molten or solid state. The returns may be from articles cast from compositions of the invention. The aluminum alloys preferably contain limited levels of carbide-forming elements such as chromium, niobium, molybdenum, or excessive copper or magnesium. Aluminum wire can include cord wire containing other alloying additions such as nickel. Commercial purity aluminum is a preferred aluminum-bearing material.

The aluminum can be added as a block, for example in a plunging bell or cage. In a preferred embodiment, the aluminum is introduced into the molten iron composition at a location below the melt surface. The aluminum may also be in the form of clean pellets, chunks, or shavings. It is also possible to add the aluminum as a wire feed.

One embodiment of the process of the invention for making a high temperature SiMo iron is given in FIG. 1. In process 100 a plurality of material streams 5 is first added into an induction furnace 10 and melted to provide a melt having an upper surface 11. The material streams 5 contain at least the elements iron, carbon, silicon and molybdenum. Following addition, it is possible to check the elemental composition of the melt to determine if adjustments in the material streams 5 should be made. The melt in the furnace 10 is optionally transferred 15 into a holding furnace 20. In an alternative embodiment, the melt made be transferred directly from the furnace 10 into the tundish 30. A holding furnace 20 is often used to provide for savings in electricity. For example, the furnace 10 may be used to produce the melt at a time of day when electrical rates are cheaper. The resulting melt is stored in a holding furnace 20 until it can be poured at a later time. From the holding furnace 20 the material is transferred 25 into a tundish 30 equipped with a teapot dam 32. The tundish 30 contains a pre-treatment alloy or nodualizer 34. The molten material is poured into the tundish so that it flows along a path 36. The nodularizuer treatment is accomplished in the tundish 30. Next, the material is transferred 35 into a pouring ladle 40. An inoculant 42 is added simultaneously with the transfer in an inoculant stream 44. The pour and the inoculant addition are preferably carried out under inert gas shrouding. The figure shows an inert gas delivery system 46 and indicates the flow 48 of the gas. Next, an aluminum-bearing material 50 is plunged 55 below the surface 11 of the molten composition. The molten composition is preferably stirred in pouring ladle 40 so that the molten aluminum follows a path 52. The molten composition in pouring ladle 40 is ready for immediate pouring.

Figure 2:
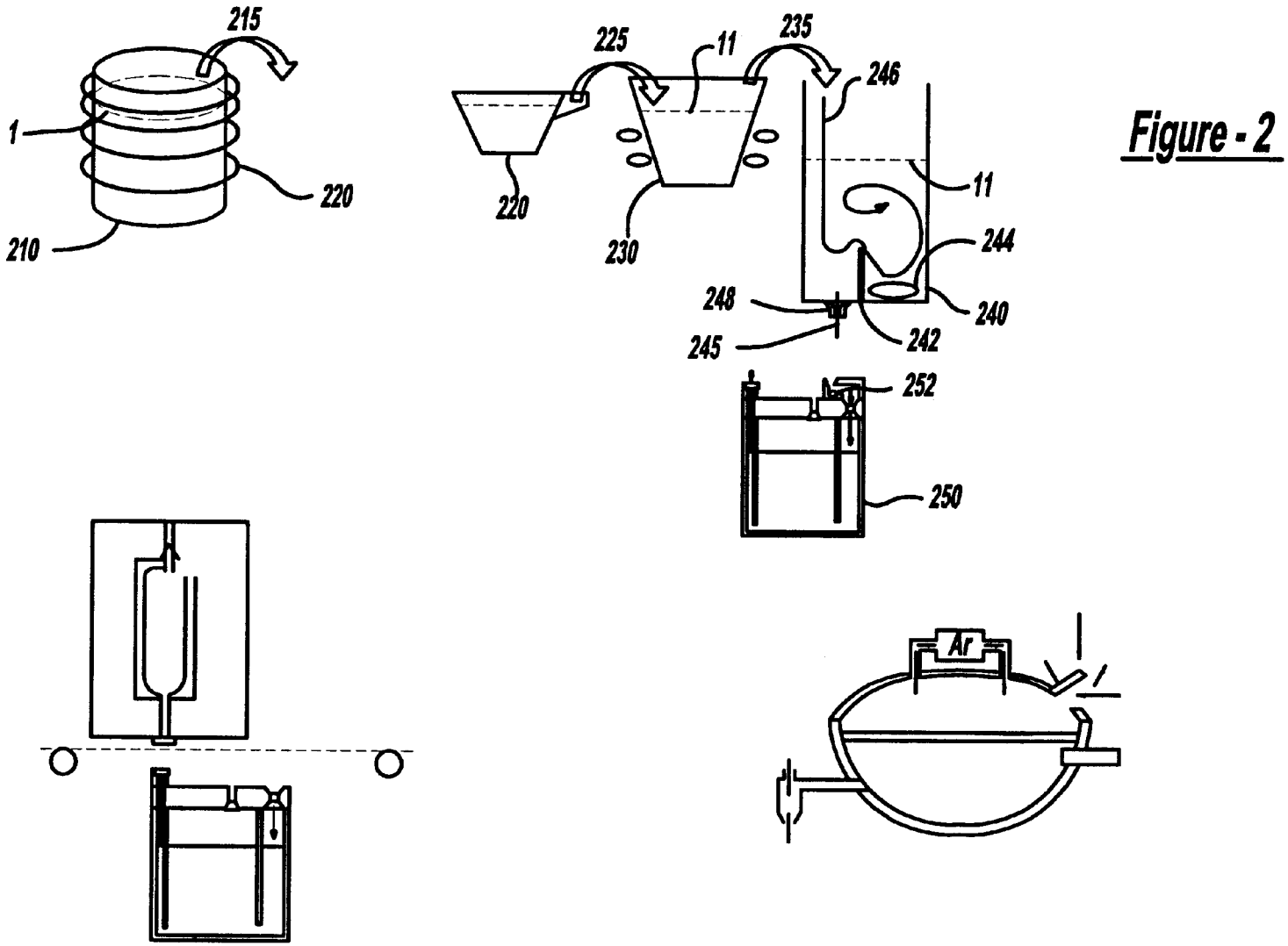
FIG. 2 is a flow diagram of another embodiment of a process according to the invention.

FIG. 2 shows another embodiment of a process 200. Material streams containing at least the elements iron, silicon, carbon and molybdenum are charged into an induction furnace 210 to level 11. After checking for elemental composition to ensure that the melt is within specifications as in FIG. 1, the melt is transferred 215 into a duplex or bull ladle 220. From the bull ladle 200 the melt is transferred 225 into a holding furnace 230. Thereafter the melt is transferred 235 from the holding furnace 230 into a tundish 240 equipped with a teapot dam 242 and containing a nodularizer 244. The melt from the holding furnace 230 is transferred into the tundish along a path 246. The tundish is equipped with a bottom exit 248 through which the contents of the tundish 240 are transferred 245 into a reaction vessel 250. An inoculant 252 is added to the stream of material from the tundish 240 to reaction vessel 250.

Figure 3:
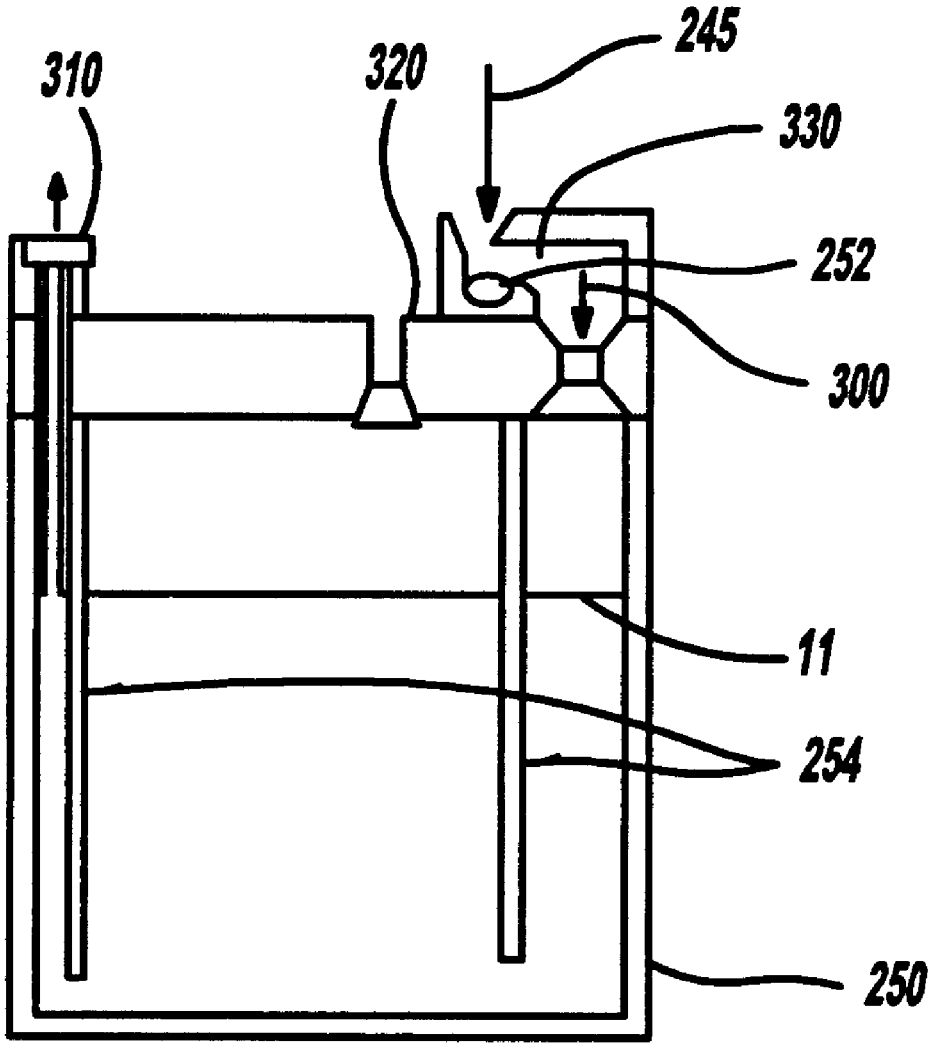
FIG. 3 is a detail of a reaction vessel used in a process of the invention.

Details of the reaction vessel of FIG. 2 are given in FIG. 3. The reaction vessel 250 has a seal 310 through which the molten composition will be poured into a mold. The seal 310 must be designed so that iron cannot pool and freeze or dross on top of the seal after the pour when the mold is removed. That is, the iron must drop back into the vessel 250 after the pour to avoid freezing at the top seal 310. The reaction vessel is also equipped with a pressure valve 320 that allows the reaction vessel 250 to be pressurized with, for example, argon to assist in pouring. Treated iron from the tundish 240 is transferred 245 into an entry passageway 330 of the reaction vessel 250. As indicated in FIG. 2, an inoculant 252 is disposed in the entry passageway. The inoculant 252 is dissolved in the treated iron as the treated iron flows through the entry passageway 330 into reaction vessel 250. The inoculant 252 may alternatively include additional cerium metal. After the iron from the tundish is added to the reaction vessel, aluminum-bearing materials are transferred 300 into the reaction vessel. Thereafter the contents of the reaction vessel 250 are poured into a mold through the seal 310.

Figure 4:
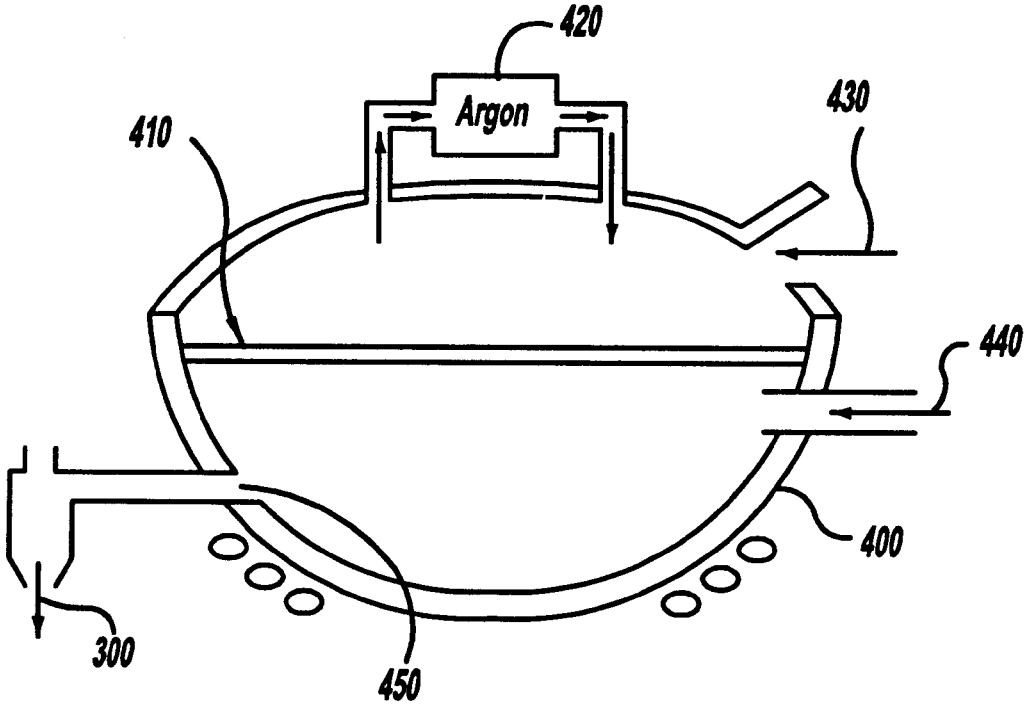
FIG. 4 is a detail of a melting/holding furnace for aluminum bearing scrap and returns used in a process of the invention.

FIG. 4 shows details of one embodiment of a process of the invention where molten aluminum is delivered into the reaction vessel. The molten aluminum is transferred 300 into the reaction vessel 250 after being collected in a holding furnace 400 for aluminum bearing scrap and returns. The holding furnace is equipped with an apparatus 420 that is used to shroud the interior of the furnace 400 with an inert gas such as argon. Aluminum-bearing materials such as scrap and returns may be added into the holding furnace 400 above the level of the melt via pathway 430 or below the level of the melt by pathway 440. The interior of the holding furnace is shrouded with an inert gas to minimize the formation of flux, slag or dross on top of the aluminum melt. FIG. 4 shows a slag cover 410 on top of the molten aluminum in the holding furnace. Preferably, the molten aluminum composition is transferred into reaction vessel through an exit port 450 below the slag cover of the molten aluminum composition. In this way the introduction of slag or dross into the reaction vessel is minimized. Alternatively, molten aluminum, molten aluminum alloy, or a wire feed may be transferred 300 into the reaction vessel without first melting and collecting the material in the holding furnace 400.

Figure 5:
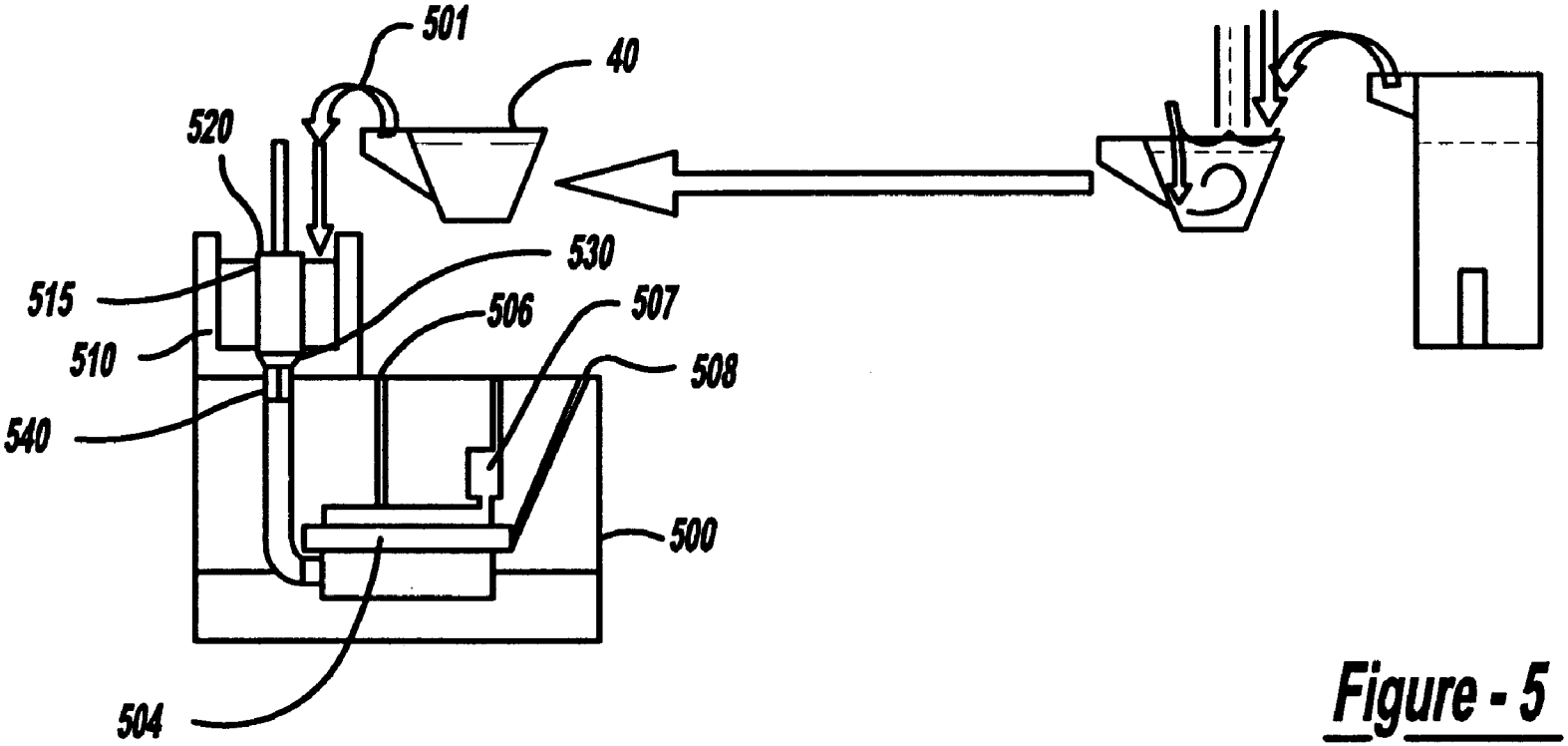
FIG. 5 is a diagram illustrating one method of pouring the compositions of the invention.

One method of pouring the compositions of the invention is illustrated in FIG. 5. A molten composition from a pouring ladle 40 is transferred 501 into a pouring basin 510. The bottom portion of the pouring basin 510 has an orifice 530 that is stoppered by a stopper rod 520 during the filling of the pouring basin 510. The pouring basin is filled to a top level 515. It is contemplated that after filling the pouring basin 510, a sufficient time elapses for dross, slag and other impurities to migrate to the top surface 515. Thereafter the stopper rod 520 is removed from the orifice 530, and the molten iron composition flows through a filter 540 into a mold 500 around a core 504. The mold 500 is equipped with vents 506, vented risers 507 and core vents 508. A preferred material for the stopper rod 520 is graphite, and the pour temperature of the iron composition into the pouring basin 510 is advantageously from about 2380° F. to about 2550° F.

The melting furnace used in the process of the invention includes those typical of use in making cast iron. As for melt temperature, it is preferred to hold the temperature as low as possible consistent with proper pouring and filling of the mold. The minimum melt temperature in the melting furnace required is dependant on heat losses during metal transfers between for example the furnace, the bull ladle, and the holding furnace. Further heat losses occur upon aluminum addition to the melt. Within the parameters of pourability and mold fillability, the temperature of the melt upon addition of aluminum should in general be as low as practical in order to minimize drossing. Generally, a melt temperature of about 2720° F. in the melting furnace is sufficient. Typical process conditions aim for about 2700–2830° F. Higher temperatures are less preferred because they may lead to undesirable reactions such as carbon loss through reaction with oxygen. For transfer to a pouring ladle, a typical temperature condition target would be about 2620 to 2660° F. to provide for minimum aluminum alloying temperatures which will allow castings to be poured. Preferred temperatures for pouring as mentioned above are those which minimize dross formation in the pour streams and in the melt during filling. Generally, it has been found that pour temperatures of about 2380° F. or above have successfully produced castings. One advantage of the compositions of the invention is that in general the pour temperature can be lower than with conventional SiMo irons. It is observed that the viscosity of the high temp SiMo containing 1–6 wt % Al is less than that of corresponding conventional SiMo irons.

After the iron-bearing materials are melted in the melting furnace, transfer ladles or tundishes can be used to add the pre-treatment alloy or nodularizer. The nodularizer can be added using split bottom, pocket, dam, sandwich, split ladles, or other typical devices. Preferably, aluminum is added to the melt without turbulence, such as with a teapot reactor as described in FIG. 3. Liquid aluminum can be injected below the molten iron surface. Alternatively, solids can be injected below the surface, and wire feed is possible through a slag and gas cover. The conditions of aluminum addition are chosen so as to minimize or avoid dross formation. For example, quiescent addition of Al is preferred, with no exposure to air at the location of the Al addition to the melt. Such a process is illustrated in FIGS. 3 and 4. During pour, the aluminum-bearing iron should also be treated so as to minimize exposure to air. An important factor is the timing to pull the stopper rod in the bottom of the pouring basin in order to float off the larger dross.

For pouring, a dry mold process may be used, or dry biscuits or shells with green sand or dry vacuum sand backing may be utilized. It is preferred to use a zircon wash on the dry mold, or to reduce the zircon wash with graphite. This seals the mold from moisture effects, and prevents dross from adhering to the mold or pour walls. In this situation, it will be easier to flush the dross through the mold and, if necessary, out the vents or risers. A vacuum assisted mold process such as the Hitchiner low vacuum type process may be used. A vacuum assist process in the mold would be expected to reduce re-oxidation and assist in filling the mold detail, because less gas would have to be displaced in order to fill the mold features. The compositions of the invention appear to have a relatively low viscosity, providing for a higher fluidity. However, oxide or dross on the surface provides an effective higher melt surface tension which can hinder the filling of fine mold surface detail, especially under slower mold filling rates. In general, faster fill rates are preferred. It may be that the faster fill rates result in the break up of surface oxide, allowing movement of the melt front into mold surface "pockets" before significant re-oxidation of the melt front surface can occur.

Generally it is preferred that the mold filling be as fast and direct as possible, and also quiescent, without generating turbulence or metal "splash" within the mold. It is preferred that the sand in the mold have a uniform hardness to prevent burn in and re-oxidation.

The cores should be very well vented. The vented ends of the cores should be clean of wash. It is possible to use gas-free cores such as for example those resulting from the CADIC sodium silicate bake process. Hollow or shell cores may also be used. However, these can be sensitive to getting all the core gas out.

Filled or pressurized gating systems may be used. In general, unidirectional flow of the molten composition in the mold is preferred, with fast flow to minimize re-oxidation. It is preferred to have a flow front that is stable and without free surface turbulence. The sprue-runner-gating system used should allow metal to flow as quickly into the mold as possible and without excessive turbulence. Direct gating practices are preferred to provide for rapid mold filling times and to minimize drossing effects on the melt surface during metal flow through the mold. During pouring, it is preferred to minimize the meeting of flow fronts in the casting. The meeting of flow fronts results in knit lines, which are flaws or weak points in the material cast. The knit lines can be characterized as an extended oxide film. Such knit line thin oxide films are often observed to nucleate a continuous graphite structure on the surface of the film. It is important to eliminate or minimize turbulence in the molten iron composition as it passes through the sprue-runner-gating system prior to entering the mold cavity. Turbulence here can entrain air or gas which can be stabilized by any oxides present in the molten composition. This will result in an undesirable porosity in the casting.

Ceramic foam filters are preferred for use in pouring compositions of the invention. In general, it is preferred to have one filter close to the down sprue and another close to the part, such as an exhaust manifold being poured. An appropriate velocity and flow rate are required to entrap dross in the filters and provide for acceptable quiescent metal flow conditions upon exiting the filter. If melt velocity near the filter is too high, the filter will not trap dross films due to the dross break up. In such a situation, dross films could pass through the filter and be observed as small films 40 to 80 microns in size present in the casting, which are often observed to serve as sites for the nucleation of graphite.

Microhardness measurements of runner walls of exhaust manifolds cast from compositions of the invention give some information and insight into the structure of the materials of the invention. Microhardness measurements for a comparative example and Examples 1–3 are given in Table III below.

TABLE III

Average Microhardness (HV) of Manifold Runner Wall (300 g Load)

| | | | Microhardness (HV) | |
|---|---|---|---|---|
| Example | Al, % | Si, % | Ferrite | Pearlite |
| Comparative Ex. | 0 | 4.0 | 217.7 | 316.8 |
| 1 | 2 | 4.0 | 256.2 | 381.7 |
| 2 | 3 | 4.0 | 299.2 | 432.7 |
| 3 | 3 | 2.8 | 230.3 | 278.3 |

The comparative example is a conventional SiMo iron. Examples 1, 2, and 3 are compositions prepared according to the processes of the invention. The aluminum and silicon contents of the compositions are given in Table III along with the microhardness in units of HV of the ferrite and the pearlite regions of the runner wall.

The microhardness is taken as an average from four to five measurements for each value. The measurement on ferrite is carried out in the region mainly containing ferrite. The pearlitic region has some carbides. Generally, the microhardness of ferrite and pearlite in the iron compositions of the invention is higher than that of the comparative example. The microhardness of ferrite and pearlite increases with increasing aluminum content. For example, at the 4% silicon level, microhardness in the ferrite and pearlite structures increased by 16.8% and 13.4%, respectively when aluminum content increased from 2% to 3%.

Increasing silicon levels increases the microhardness of ferrite and pearlite. At 3% aluminum, an increase in silicon from 2.8% to 4% resulted in an increase in the microhardness of ferrite and pearlite of 29.9% and 55.5%, respectively.

Irons having high aluminum and silicon content in the prior art were too hard to be machined. Compositions of the invention, on the other hand, produce molded parts having a machinability comparable to that of regular SiMo iron. The compositions of the invention also have a Brinell hardness equivalent to that obtained with regular SiMo iron. The Brinell hardness is representative of an average hardness of the entire cast iron structure. It appears that with the compositions and process of the invention, an iron structure having from about 1.0 to 6.0% by weight aluminum has a structure with relatively low pearlite and primary carbide formation. As a general rule, the presence of pearlite, and primary carbide tends to increase the average hardness of a material, which tends to cause tool wear during machining. The carbides also provide effective crack nucleation sites which, because the intrinsic hardness and brittleness of the ferrite matrix is increased by the high total aluminum and silicon content, cause the damage tolerance and overall brittleness of the iron to be compromised. It is believed that the control achieved by the current invention over the pearlite and carbide content in the aluminum-bearing nodular or compacted graphite iron is a key to the production of this iron as a useful engineering structural material.

Example 4

A manifold for a 1.8 liter engine was cast from an iron composition containing 3.8% carbon, 2.8% silicon, 2.85% residual aluminum (3 wt % aluminum was added to the melt; however, due to losses resulting from dross formation, a final aluminum composition of 2.85% was recovered in the final melt), and 0.6% molybdenum, where all percentages are percentages by weight. The melt furnace temperature was 2830° F. The nodularizer addition employed was 1.35 wt % ReMag® and inoculation was carried out in the ladle with 0.4 wt % Calsifer. The aluminum was added to the melt after inoculation, plunging a solid mass of aluminum beneath the molten iron surface. The main rare earth addition consisted of 0.1 wt % cerium mischmetal (containing about 50% cerium) added with the aluminum. The pour temperature was 2600° F. The casting could be handled and machined without brittle fracture. The microstructure displayed good nodularity (approximately 80%), nodule count (approximately 150 nodules/mm$^2$ and reasonably low pearlite (approximately 25%) and carbide (approximately 5%) levels.

Example 5

A manifold for a 1.8 liter engine was cast from an iron composition containing 3.5% carbon, 3.6% silicon, 3.0% residual aluminum (3 wt % residual aluminum was recovered in the final melt, representing a recovery of 87% of the aluminum added, with losses likely resulting from dross formation) and 0.6% molybdenum, where all percentages by weight. The melt furnace temperature was 2822° F. The nodularizer addition employed was 1 wt % ReMag® and inoculation was carried out in the ladle with 1 wt % Ultraseed®. After treatment, the temperature was 2651° F. The main rare earth addition consisted of 0.1 wt % high cerium rare earth alloy (containing about 92% cerium) added with the inoculant. The aluminum was added to the melt after inoculation, plunging a solid mass of aluminum beneath the molten iron surface. The pour temperature into the mold was 2562° F. The microstructure of the cast material displayed good nodularity, nodule count and low pearlite and carbide levels.

Example 6

A manifold for a 1.8 liter engine was cast from an iron composition containing 3.5% carbon, 3.6% silicon, 3.0% residual aluminum, (representing a recovery of 87% of the aluminum added, with losses likely resulting from dross formation), 0.6% molybdenum and 2.0% nickel, where all percentages are percentages by weight. The nickel was added as pure nickel to the base iron composition, prior to any nodularizer addition. The melt furnace temperature was 2749° F. The nodularizer addition employed was 1 wt % ReMag® and inoculation was carried out in the ladle with 1 wt % Ultraseed®. The main rare earth addition consisted of 0.1 wt % high cerium rare earth alloy (containing about 92% cerium) added with the inoculant. The aluminum was added to the melt after inoculation, plunging a solid mass of aluminum beneath the molten iron surface. The pour temperature was 2534° F. The microstructure of the cast material displayed good nodularity, nodule count and low pearlite and carbide levels. In addition, the surface appearance resembled that of a stainless steel casting, making it esthetically attractive. This trial was carried out to produce an aluminum ductile iron with potential improvements in high temperature oxidation resistance.

Example 7

A manifold for a 1.8 liter engine was cast from an iron composition containing 3.7% carbon, 3.2% silicon, 2.85% residual aluminum, (3 wt % aluminum was added to the melt, however, due to losses likely resulting from dross formation a final aluminum composition of 2.85% was recovered in the final melt) and 0.6% molybdenum, where all percentages are percentages by weight. The melt furnace temperature was 2737° F. The nodularizer addition employed was 1 wt % ReMag® and inoculation was carried out in the ladle with 1 wt % Ultraseed®. After treatment, the temperature was 2643° F. The main rare earth addition consisted of 0.1 weight percent cerium mischmetal (containing about 50% cerium) added with the inoculant. The aluminum was added to the melt after inoculation, plunging a solid mass of aluminum beneath the molten iron surface. The pour temperature was 2510–2520° F.

The manifold was evaluated in an engine exhaust simulation test. The test consisted of 450 thermal cycles with an exhaust gas temperature of 1950° F. (1066° C.). A thermal cycle consisted of a 10 minute heating portion with burners on followed by a 10 minute cooling period with burners off. Following the 450 thermal cycles, the manifold was subjected to another 260 thermal cycles with heat shields applied. The manifold showed good stability and heat resistance in the engine exhaust simulation test. In particular, the manifold did not fail and remained integral and functioning through the 450 thermal cycles without heat shields and 260 additional thermal cycles with heat shield applied.

Figure 6:
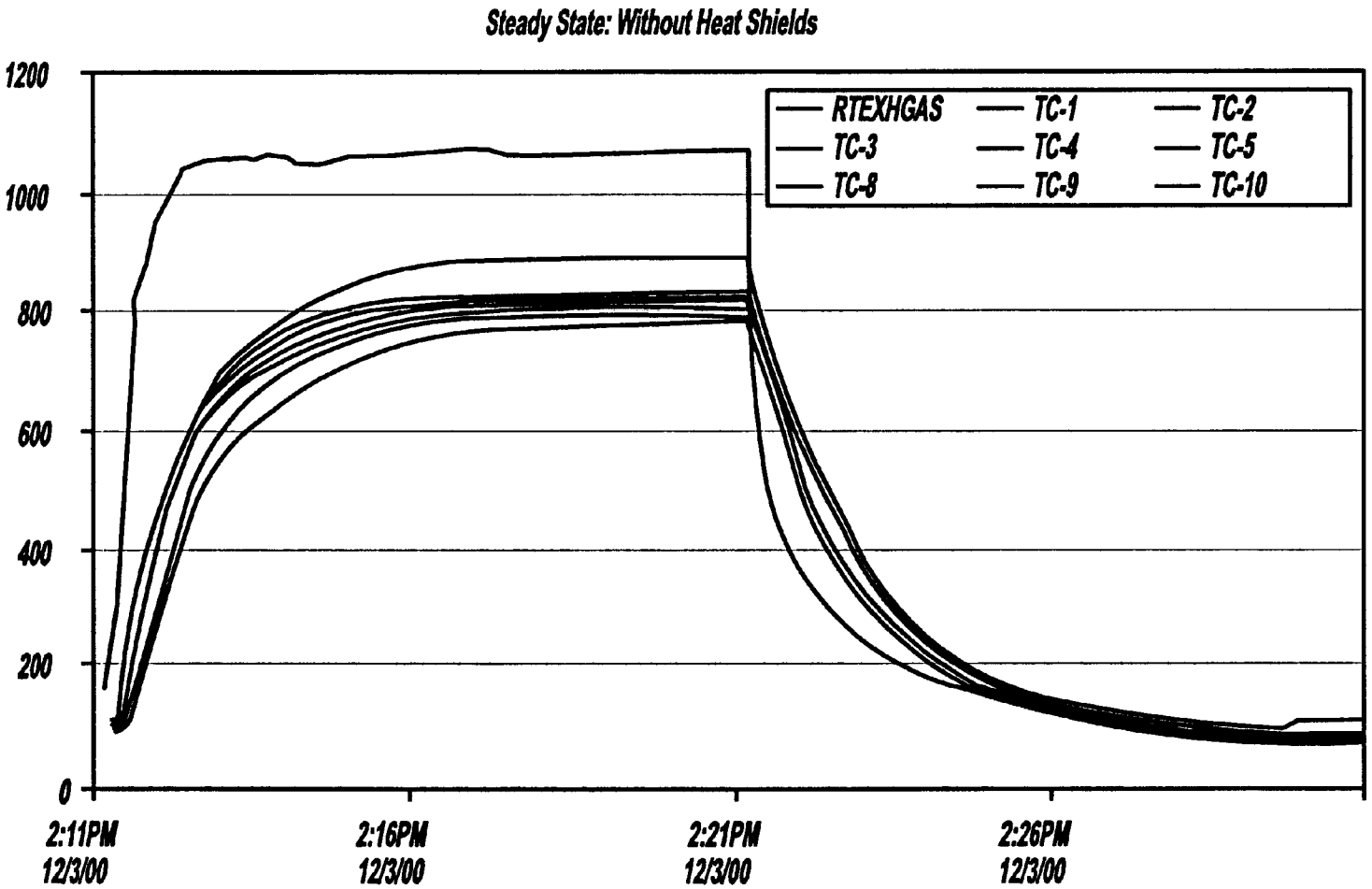
FIG. 6 is a graph of exhaust gas temperature and exhaust manifold surface temperatures during one thermal cycle.

FIG. 6 shows the temperature profile of the exhaust gas (upper curve labeled "RTEXHGAS") and 8 points on an exhaust manifold during a typical cycle of the EES test described above. The burners were turned on between 2:11 p.m. and 2:21 p.m. for a total of 10 minutes, followed by a 10 minute period of cooling. It can be seen that by the end of the 10 minute heating period, the exhaust gas had a temperature of about 1080–1100° C. and portions of the surface of the manifold reached temperatures varying from just below 800° C. to around 900° C. After the burners are turned off, which occurs in FIG. 6 at the abscissa point labeled as 2:21 p.m., the exhaust gas and manifold cool down within a period of 5 or 6 minutes to a uniform temperature of about 100° C. The nine curves in FIG. 6 refer to the temperature profile of the exhaust gas stream (RTEXHGAS) and eight different parts of the exterior exhaust manifold surface during a thermal cycle.

Figure 7:
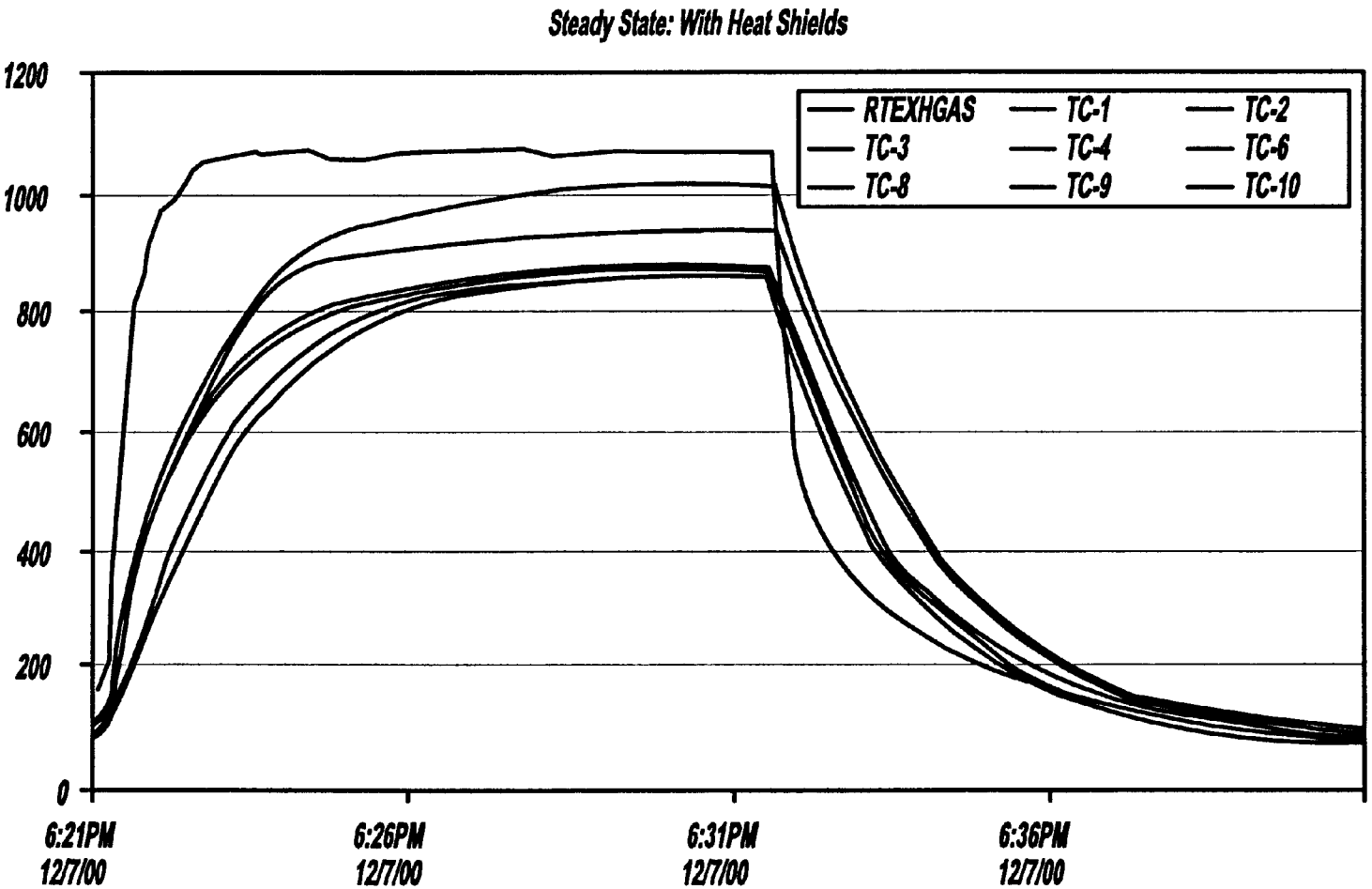
FIG. 7 is a graph of exhaust gas temperature and exhaust manifold surface temperatures during one thermal cycle with heat shields applied.

FIG. 7 shows a typical temperature profile during one of the 260 cycles carried out with a heat shield applied. With a heat shield applied, the surface of the exhaust manifold increased during the heating cycle up to temperatures of up to about 900° C. to over 1000° C. During the cooling phase, the exhaust manifold cooled down to a uniform temperature of about 100° C. As in FIG. 6, the nine curves of FIG. 7 show the temperature cycling data of the exhaust gas stream (RTEXHGAS, the highest temperature curve) and at 8 points on the exhaust manifold exterior surface.

Compositions similar to those of Examples 4, 5 and 7 were poured into a mold at temperatures as low as 2419° F. with 80% to make molded cast iron articles having 80% or higher modularity. Pour temperatures of as low as 2365° F. have resulted in molded articles having a nodularity of 70% or greater.

Example 8

Figure 8:
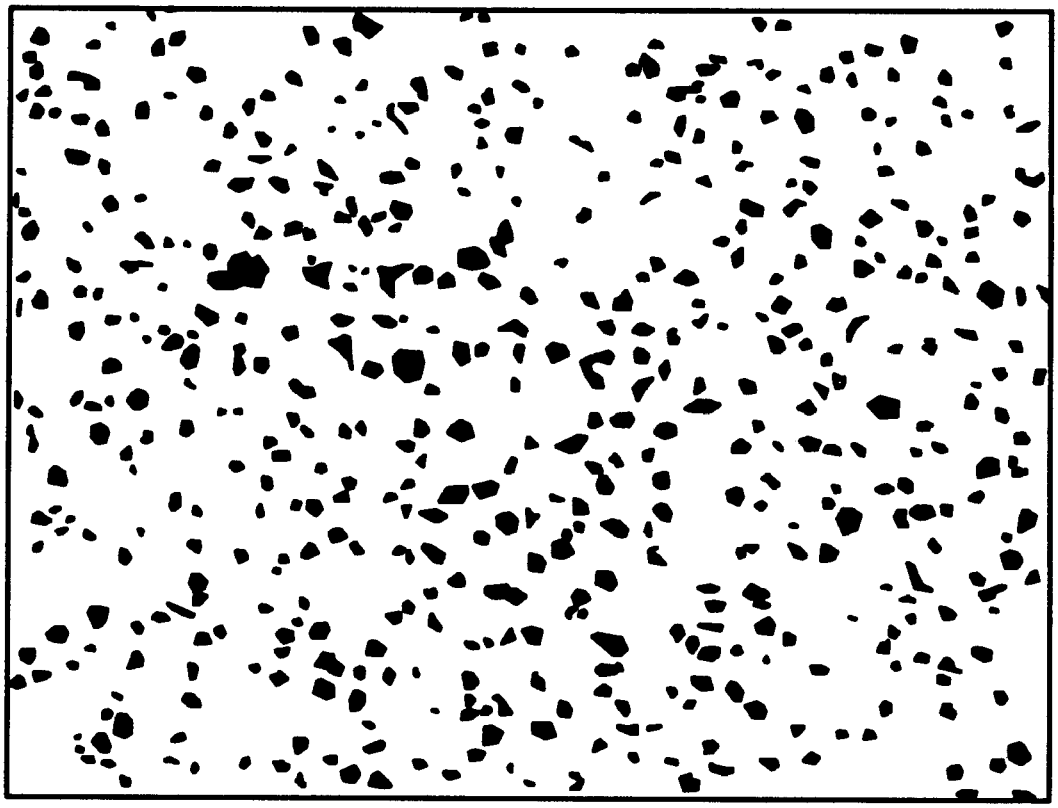
FIG. 8 is a micrograph of a thin cross section of an exhaust manifold made according to the invention.
Figure 9:
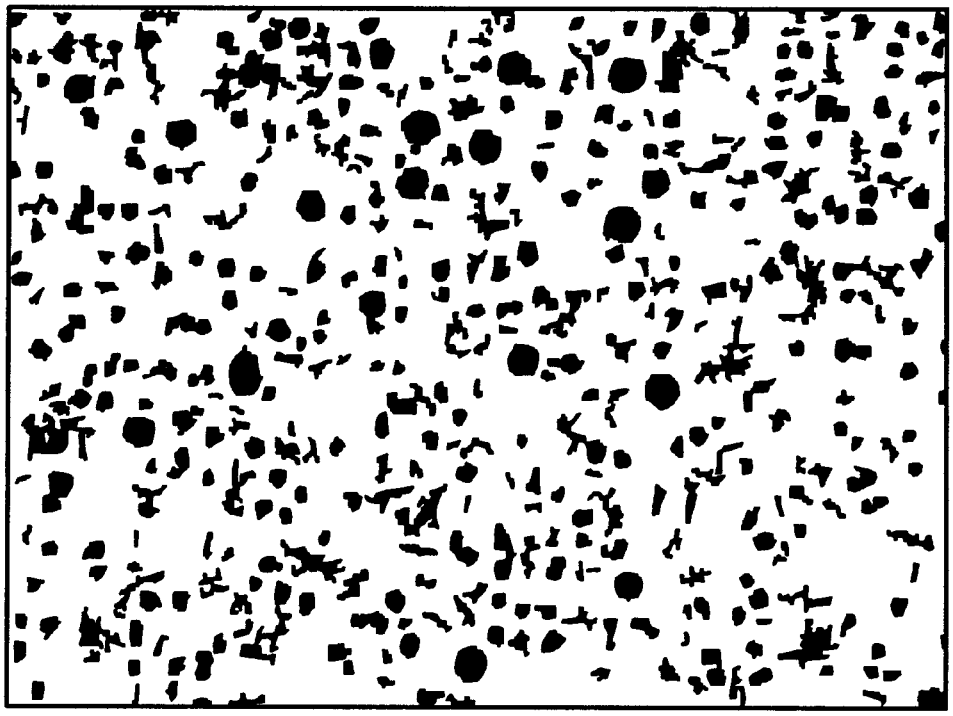
FIG. 9 illustrates the same region as FIG. 8 after etching.

An exhaust manifold was prepared according to the invention from a cast iron composition containing 3.4% carbon, 4.0% silicon and 3.0% aluminum. FIG. 8 is a micrograph of a section of approximately 4 mm thick cut from the thin wall region of the cast manifold. FIG. 9 is a micrograph of the same structure after etching. The figures indicate desirable low levels of molybdenum rich primary eutectic carbides and eutectoid pearlite.

The invention has been described with respect to several non-limiting preferred embodiments. In light of the description given above, variations will occur to those of skill in the art that are also in the scope of the invention as determined by the appended claims.

We claim:

1. A molded article comprising a nodular or compacted graphite cast iron composition, wherein the cast iron composition comprises greater than about 50 wt % iron, from about 2.0 to about 5.0 wt % silicon;

from about 1.0 to about 6.0 wt % aluminum, and from about 0.02 to about 0.8 wt % cerium, wherein a tensile test of the article at room temperature results in an elongation greater than 0.

2. A molded article according to claim 1 wherein the tensile test results in elongation greater than about 1%.

3. An article according to claim 1 wherein the iron composition comprises greater than or equal to about 0.03 wt % cerium.

4. An article according to claim 1 wherein the iron composition comprises greater than about 2.5 wt % aluminum.

5. An article according to claim 1 wherein the iron composition comprises from about 3.0 to about 4.0 wt % aluminum.

6. An article according to claim 1 wherein the iron composition comprises silicon and carbon in an amount such that the wt % carbon plus ⅓ the wt % silicon is up to about 5.2 wt %.

7. An article according to claim 6 wherein the iron composition further comprises up to about 1.5 wt % molybdenum.

8. An article according to claim 6 wherein the iron composition further comprises up to about 7.0 wt % nickel.

9. An article according to claim 6 wherein the iron composition comprises greater than about 2.5 wt % aluminum.

10. An article according to claim 6 wherein the iron composition comprises less than 2.5 wt % aluminum and from about 2.0 to about 3.8 wt % silicon.

11. An article according to claim 1 wherein the iron composition comprises from about 0.02 wt % to about 0.2 wt % cerium.

12. An article according to claim 1 wherein the article is an exhaust component.

13. An article according to claim 1 wherein the article is an exhaust manifold.

14. An article according to claim 1 wherein the article is a turbocharger component.

15. An article according to claim 1 wherein the article is a transmission component.

16. An article according to claim 1 wherein the article is a fuel cell component.

17. An article according to claim 1 wherein the article is an exhaust manifold that survives through 450 cycles of exposure to exhaust gas of temperature 1950° F. for ten minutes followed by a ten minute cooling period.

18. An article according to claim 16 wherein the iron composition comprises about 0.02 wt % to about 0.2 wt % cerium.

19. A cast iron composition comprising, in addition to greater than about 60.0 wt % iron:

from about 1.0 to about 6.0 wt % aluminum;

from about 2.0 to about 5.0 wt % silicon;

carbon in an amount such that the weight percent carbon plus ⅓ the weight percent silicon is less than or equal to about 5.5%;

up to about 1.5 wt % molybdenum; and from about 0.02 to about 0.8 wt % cerium.

20. A composition according to claim 19 comprising greater than or equal to about 0.03 wt % cerium.

21. A composition according to claim 19 further comprising up to about 7.0 wt % nickel.

22. A composition according to claim 19 comprising greater than 2.5 wt % aluminum.

23. A composition according to claim 22 comprising greater than or equal to about 0.03 wt % cerium.

24. A composition according to claim 21 comprising greater than 2.5 wt % aluminum.

25. A composition according to claim 24 comprising greater than or equal to about 0.03 wt % cerium.

26. A composition according to claim 19 comprising less than about 2.5 wt % aluminum and from about 2.0 to about 3.8 wt % silicon.

* * * * *